US010249967B2

(12) United States Patent
Li et al.

(10) Patent No.: US 10,249,967 B2
(45) Date of Patent: Apr. 2, 2019

(54) ELECTRONIC DEVICE AND CONNECTING METHOD

(71) Applicant: Delta Electronics, Inc., Taoyuan (TW)

(72) Inventors: Shang-Yu Li, Taoyuan (TW); Hung-Chi Chen, Taoyuan (TW); Do Chen, Taoyuan (TW); Ching-Ho Chou, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 15/617,579

(22) Filed: Jun. 8, 2017

(65) Prior Publication Data

US 2018/0212339 A1 Jul. 26, 2018

(30) Foreign Application Priority Data

Jan. 20, 2017 (CN) ..... 2017 1 0047828

(51) Int. Cl.

| | |
|---|---|
| ***H01R 12/58*** | (2011.01) |
| ***H01R 4/60*** | (2006.01) |
| *H01R 4/18* | (2006.01) |
| *H01R 4/20* | (2006.01) |

(52) U.S. Cl.

CPC ..... *H01R 12/58* (2013.01); *H01R 4/60* (2013.01); *H01R 4/183* (2013.01); *H01R 4/20* (2013.01)

(58) Field of Classification Search

CPC ..... H01R 12/58; H05K 3/3447; H05K 3/4046

USPC ..... 439/82–84, 741–743, 876

See application file for complete search history.

(56) References Cited

U.S. PATENT DOCUMENTS

| | | | | |
|---|---|---|---|---|
| 3,953,103 A * | 4/1976 | Mathis | H01R 4/185 | 174/267 |
| 4,181,385 A * | 1/1980 | DeSantis | H01R 12/58 | 439/83 |
| 4,881,906 A * | 11/1989 | Mackanic | H01R 12/526 | 29/843 |
| 5,115,375 A * | 5/1992 | Garay | H05K 7/142 | 361/760 |
| 5,281,770 A * | 1/1994 | Kamei | H05K 3/3447 | 174/261 |
| 5,975,963 A * | 11/1999 | Higuchi | H01R 4/028 | 439/83 |
| 7,182,655 B2 * | 2/2007 | Chen | H01R 4/028 | 174/261 |

* cited by examiner

*Primary Examiner* — Ross N Gushi

(74) *Attorney, Agent, or Firm* — Muncy, Geissler, Olds & Lowe, P.C.

(57) ABSTRACT

An electronic device connected to a wire is provided, including a printed circuit board having a hole, a hollow tube, a plurality of blades separated from each other, and a solder, wherein the wire in inserted into the hollow tube and electrically connected to the printed circuit board. The hollow tube is extended through the hole. The solder is connected to the blades and the printed circuit board. The blades are connected to the hollow tube, and a reflex angle is formed between the inner wall of the hollow tube and each of the blades.

15 Claims, 17 Drawing Sheets

ELECTRONIC DEVICE AND CONNECTING METHOD

CROSS REFERENCE TO RELATED APPLICATIONS

The present application is based on, and claims priority from, China Patent Application No. 201710047828.6, filed on Jan. 20, 2017, the disclosure of which is hereby incorporated by reference herein in its entirety.

BACKGROUND OF THE INVENTION

Field of the Invention

The application relates in general to an electronic device, and in particular, to an electronic device connected to a wire via a hollow tube.

Description of the Related Art

Conventional methods for affixing a wire to a printed circuit board usually comprise two steps: a plurality of wires are first mounted on a printed circuit board, and then the printed circuit board with the wires can pass through an air reflow oven to solder the wires to the printed circuit board.

However, some disadvantages are generated by the aforementioned fixing method: (1) since the wires are mounted to the printed circuit board in advance, the tool used for passing the printed circuit board through the air reflow oven must be large, and the time it takes to pass through the oven is therefore increased; (2) the surface of the wires might be influenced by the heat provided by the oven or by coming into contact with the oven, such as by shrinking or having bubbles form; (3) the tool used for passing the printed circuit board through the oven must be specially made, which increases the cost; (4) since the electronic elements must be mounted on the printed circuit board before the wires, the assembly time is increased; and (5) after the wire is soldered onto the printed circuit board, the printed circuit board with the wires is sequentially packaged in a case, so that the soldered joint may be pulled, and thus the solder might be detached or rent from the printed circuit board.

BRIEF SUMMARY OF INVENTION

To address the deficiencies of conventional products, an embodiment of the invention provides an electronic device connected to a wire, including a printed circuit board having a hole, a hollow tube, a plurality of blades separated from each other, and a solder, wherein the wire in inserted into the hollow tube and electrically connected to the printed circuit board. The hollow tube is extended through the hole. The solder is connected to the blades and the printed circuit board. The blades are connected to the hollow tube, and a reflex angle is formed between the inner wall of the hollow tube and each of the blades.

In some embodiments, the blades comprise at least one first blade, and the reflex angle formed between the inner wall of the hollow tube and the first blade is 180 degrees-270 degrees.

In some embodiments, when the reflex angle formed between the inner wall of the hollow tube and the first blade is 270 degrees, the first blade contacts the printed circuit board, and the solder surrounds the first blade.

In some embodiments, the blades comprise at least one second blade, and the reflex angle formed between the inner wall of the hollow tube and the second blade is 180 degrees-270 degrees.

In some embodiments, the second blade has an inner surface and an outer surface opposite to the inner surface, wherein the inner surface is connected to the inner wall of the hollow tube, and a portion of the solder is disposed between the outer surface and the printed circuit board.

In some embodiments, the blades comprise a plurality of first blades and a plurality of second blades, the reflex angle formed between the inner wall of the hollow tube and each of the first blades exceeds that between the inner wall of the hollow tube and each of the second blades, and the first blades and the second blades are staggered.

In some embodiments, the printed circuit board has a first surface and a second surface, wherein the hole extends from the first surface to the second surface, and the blades protrude from the first surface.

In some embodiments, the first surface is opposite to the second surface.

In some embodiments, the hollow tube comprises a protrusion, wherein the width of the protrusion exceeds that of the hole, and the protrusion contacts the second surface.

In some embodiments, the hollow tube comprises at least one concave structure, and the concave structure contacts the wire.

In some embodiments, a portion of the solder enters the hollow tube.

In some embodiments, a gap is formed between the solder and the wire.

In some embodiments, the number of blades is two to six.

In some embodiments, the hollow tube comprises nickel.

An embodiment of the invention further provides a connecting method, comprising: disposing a tubular member in a hole of the printed circuit board; bending a portion of the tubular member protruding from a first surface of the printed circuit board to form a hollow tube and a bending portion; cutting the bending portion to form a plurality of blades; welding the blades and the printed circuit board; inserting the wire into the hollow tube; and compressing the wall of the hollow tube until the inner wall of the hollow tube contacts the wire.

In some embodiments, the connecting method further comprises adjusting the angle between the first surface and each of the blades.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The embodiments of the electronic device are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

Unless defined otherwise, all technical and scientific terms used herein have the same meaning as commonly understood to one of ordinary skill in the art to which this invention belongs. It should be appreciated that each term, which is defined in a commonly used dictionary, should be interpreted as having a meaning conforming to the relative skills and the background or the context of the present disclosure, and should not be interpreted by an idealized or overly formal manner unless defined otherwise.

Figure 1:
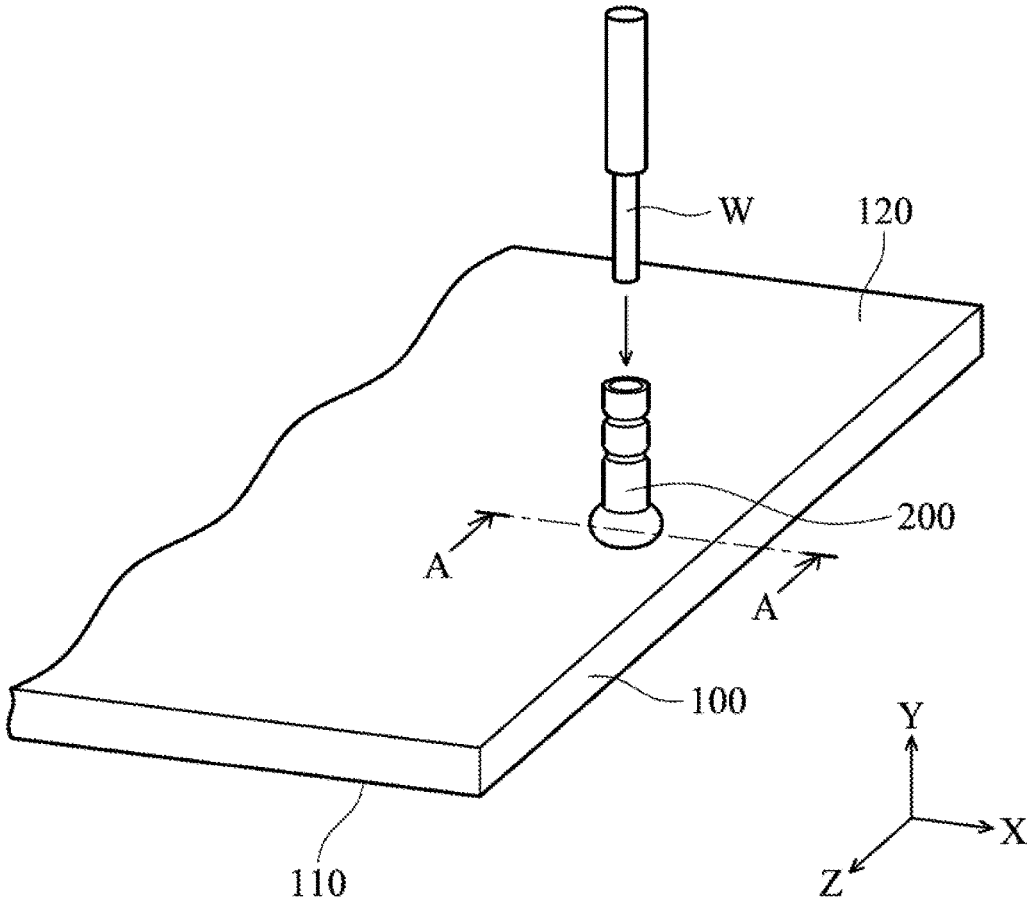
FIG. 1 is a schematic diagram of an electronic device according to an embodiment of the invention.
Figure 2:
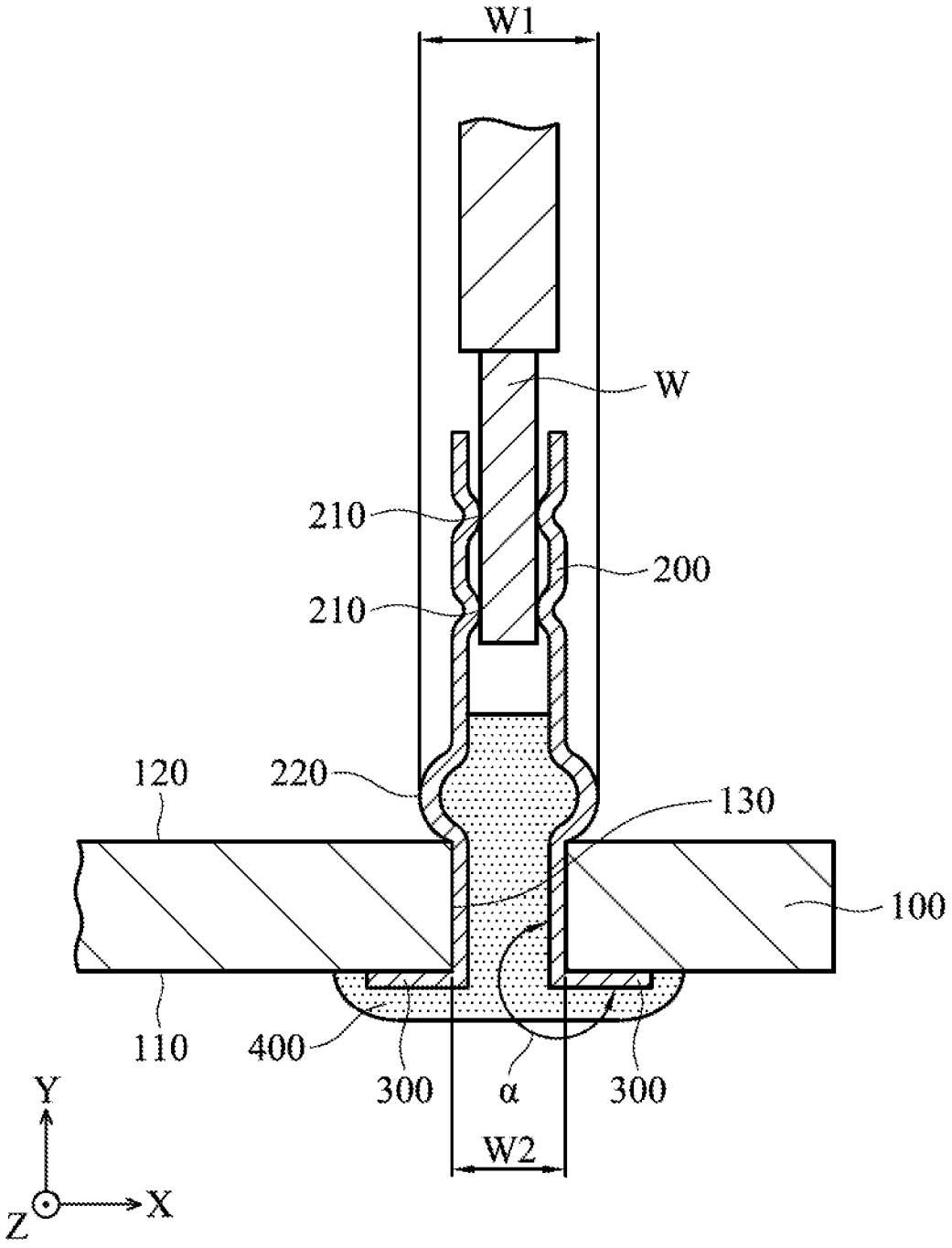
FIG. 2 is a cross-sectional view along line A-A in FIG. 1.

Referring to FIGS. 1 and 2, an electronic device in an embodiment of the invention comprises a printed circuit board 100, a hollow tube 200, a plurality of blades 300, and a solder 400. The hollow tube 200 is disposed on the printed circuit board 100, and a wire W can be inserted into the hollow tube 200 for electrically connecting the printed circuit board 100.

As shown in FIGS. 1 and 2, the printed circuit board 100 comprises a first surface 110, a second surface 120, and a hole 130. The first surface 110 and second surface 120 are disposed on the opposite sides of the printed circuit board 100, and the hole 130 is extended from the first surface 110 to the second surface 120.

The hollow tube 200 can be extended through the hole 130, and connected to the blades 300 at the first surface 110. When the wire W is inserted into the hollow tube 200, it can be clamped by at least one concave structure 210 on the inner wall of the hollow tube 200, so that the wire W can be fixed relative to the hollow tube 200. In this embodiment, the diameter of the hollow tube 200 is substantially the same as that of the hole 130. Therefore, the outer wall of the hollow tube 200 can contact the wall of the hole 130, and oscillation between the hollow tube 200 and the printed circuit board 100 can be avoided. Moreover, the hollow tube 200 further comprises a protrusion 220. The width W1 of the protrusion 220 exceeds the width W2 of the hole 130, and the protrusion 220 can contact the second surface 120 of the printed circuit board 100. Therefore, the length of the portion of the hollow tube 200 entering the hole 130 can be determined, and the hollow tube 200 can be prevented from falling through the hole 130.

Figure 3:
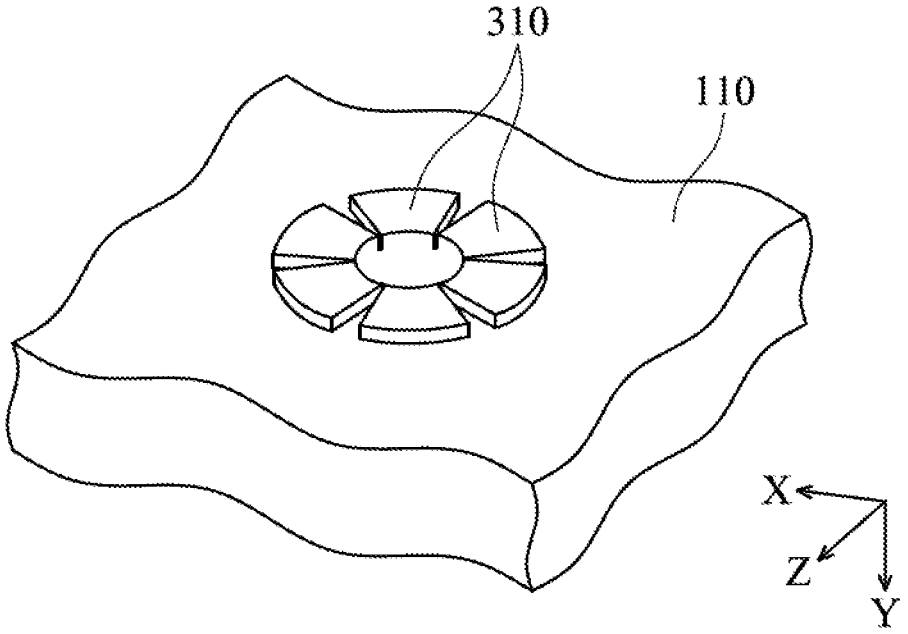
FIG. 3 is a schematic diagram of the first blades according to an embodiment of the invention.
Figure 4A:
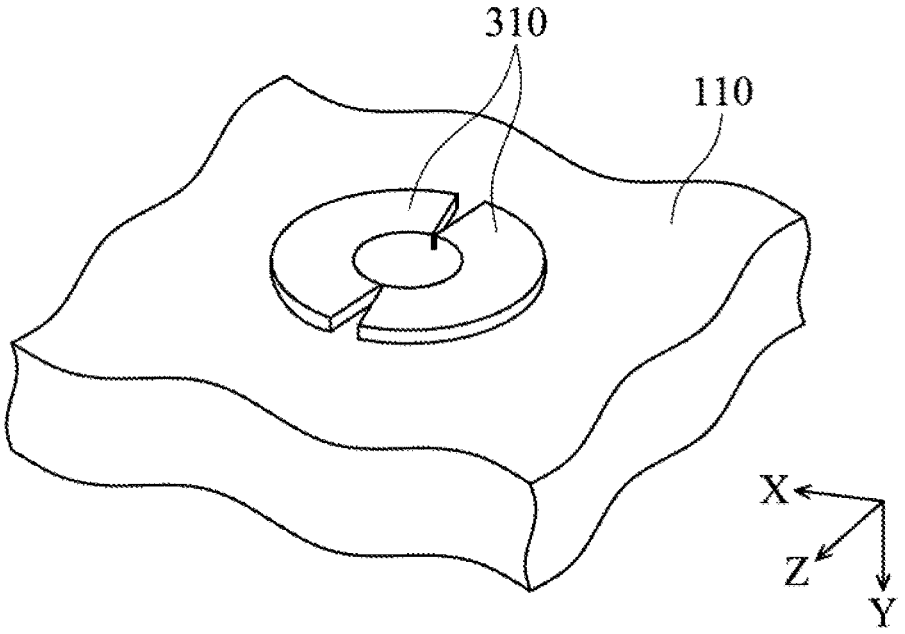
FIG. 4A is a schematic diagram of the first blades according to another embodiment of the invention.
Figure 4B:
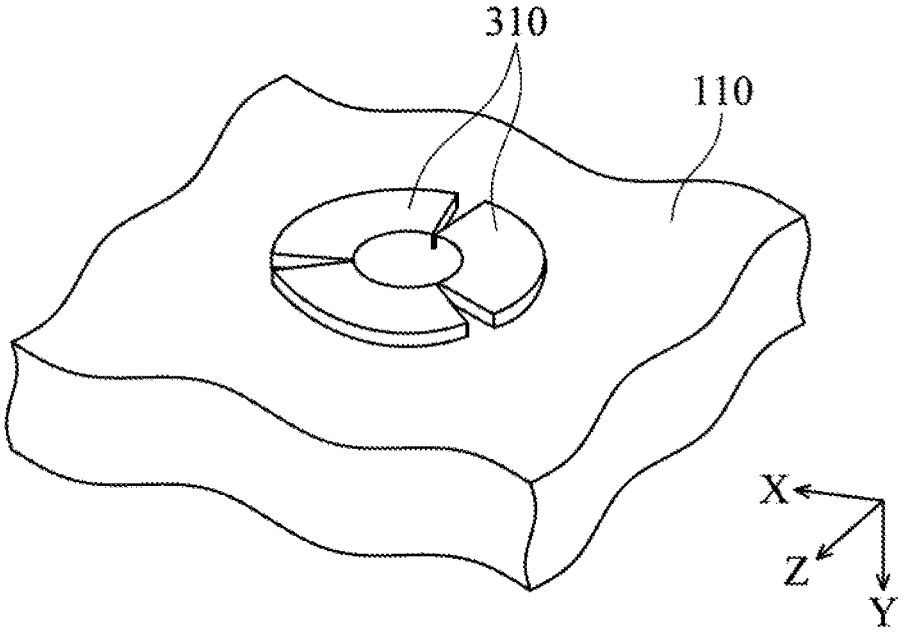
FIG. 4B is a schematic diagram of the first blades according to another embodiment of the invention.
Figure 4C:
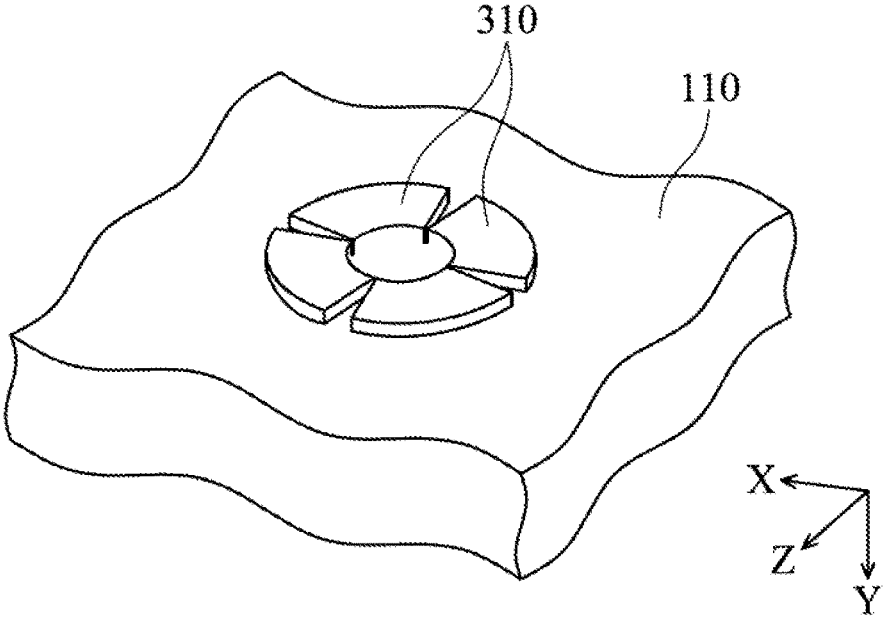
FIG. 4C is a schematic diagram of the first blades according to another embodiment of the invention.
Figure 4D:
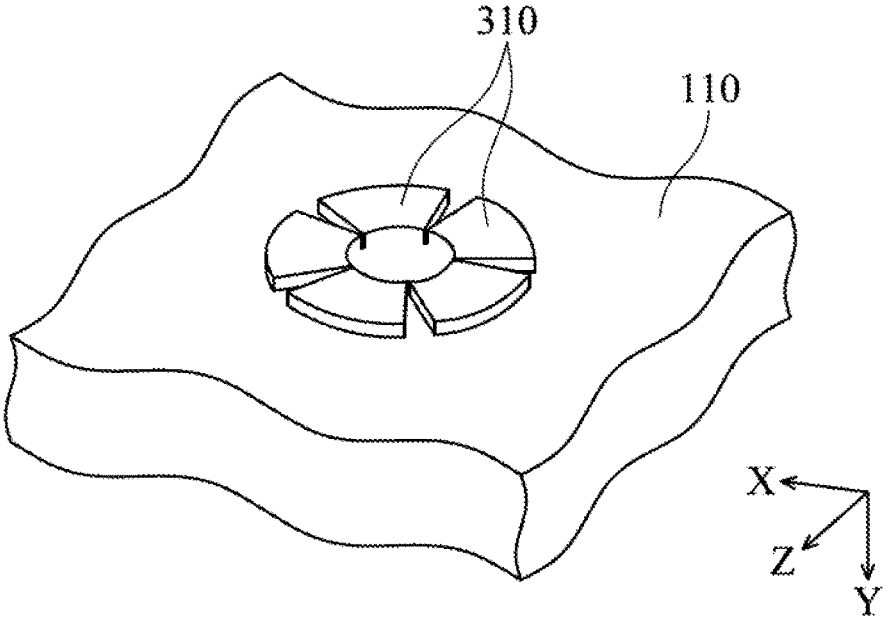
FIG. 4D is a schematic diagram of the first blades according to another embodiment of the invention.

Referring to FIGS. 2 and 3, in this embodiment, the blades 300 comprise six first blades 310 separated from each other. Each of the first blades 310 has a fan-shaped structure, protrudes from the first surface 110 of the printed circuit board 100, and is attached on the first surface 110. Thus, a reflex angle $\alpha$ can be formed between the inner wall of the hollow tube 200 and each of the first blades 310, wherein the reflex angle $\alpha$ is about 270 degrees. The solder 400 surrounds the first blades 310 and connects the first blades 310 with the printed circuit board 100, such that the first blades 310 can be affixed to the first surface 110 of the printed circuit board 100.

It should be noted that, since the hollow tube 200 is connected to the first blades 310, the hollow tube 200 cannot be pulled out from the second surface 120 easily. Furthermore, since the aforementioned first blades 310 are disposed separately, the solder 400 can contact the first blades 310 and the first surface 110 of the printed circuit board 100 at the sides of the first blades 310 (between two adjacent first blades 310) and the outer circumference of the first blades 310. The first blades 310 and the printed circuit board 100 can be adhered together by the solder 400 to prevent rotation of the hollow tube 200 and the first blades 310 relative to the printed circuit board 100. Since the area of contact between the solder 400 and the blades 300 is enlarged, the blades 300 can be affixed to the printed circuit board 100 steadily.

In this embodiment, a portion of the solder 400 covers the first blades 310, and a portion of the solder 400 enters the hollow tube 200. Therefore, the quantity of the solder 400 and the area of contact for the solder 400 can be enlarged, and the fixing effect is improved. It should be noted that, even when the solder 400 enters the hollow tube 200, a gap is still formed between the solder 400 and the wire W to prevent a short-circuit from occurring. In this embodiment, the hollow tube 200 and the blades 300 comprise nickel, and can be integrally formed as one piece.

In some embodiments, the number of first blades 310 can be adjusted as required. Referring to FIGS. 4A-4D, for example, the number of first blades 310 can be two to five. When the number of first blades 310 is greater, the area of contact for the solder 400 is enlarged. However, the number of first blades 310 should be adjusted according to the dimensions of the hollow tube 200. For example, when the hollow tube 200 has a small diameter (such as the inner diameter of the hollow tube 200 is 0.1 mm-0.3 mm), the electronic device having six first blades 310 connected to the hollow tube 200 is preferred.

Figure 5:
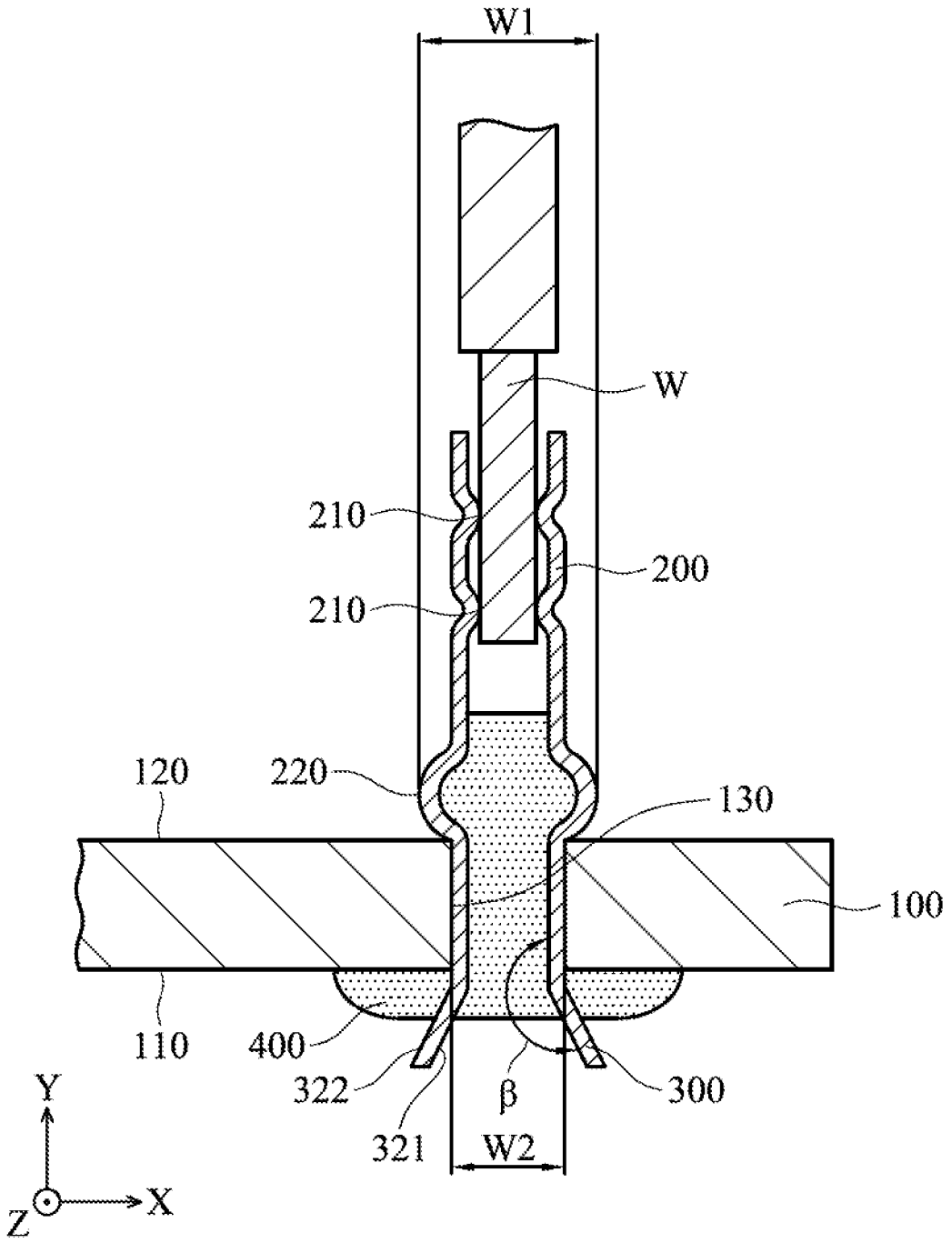
FIG. 5 is a schematic diagram of an electronic device according to another embodiment of the invention.
Figure 6:
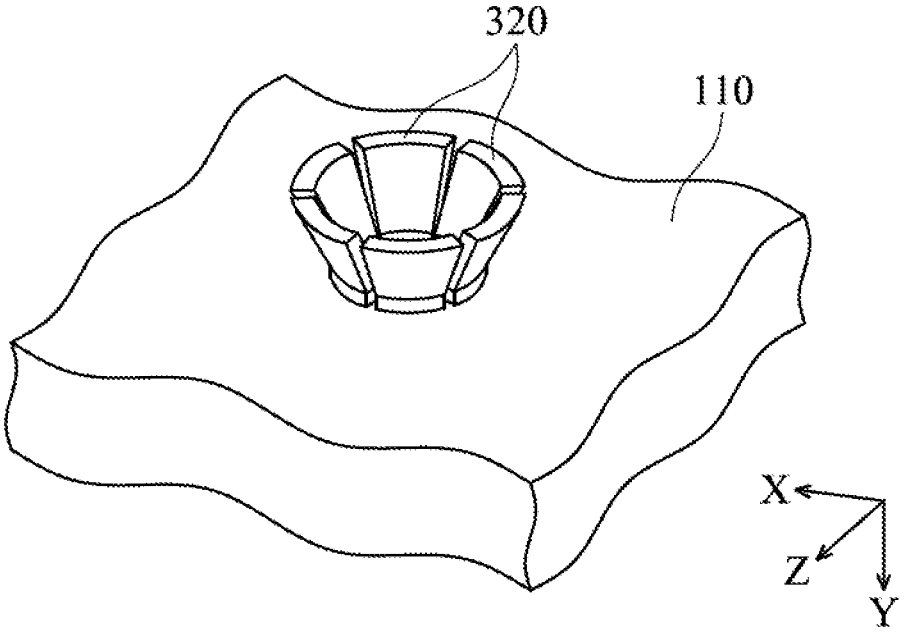
FIG. 6 is a schematic diagram of the second blades according to another embodiment of the invention.
Figure 7A:
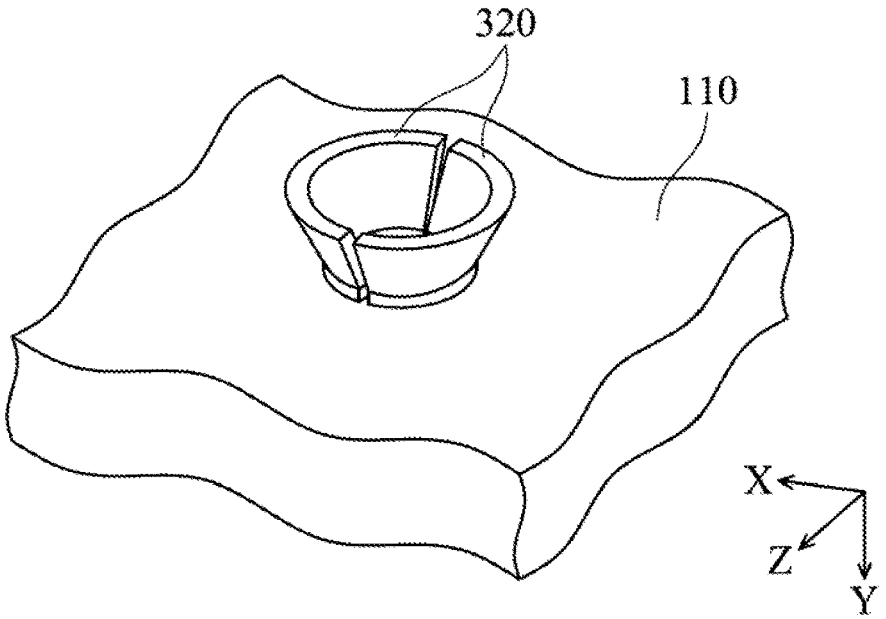
FIG. 7A is a schematic diagram of the second blades according to another embodiment of the invention.
Figure 7B:
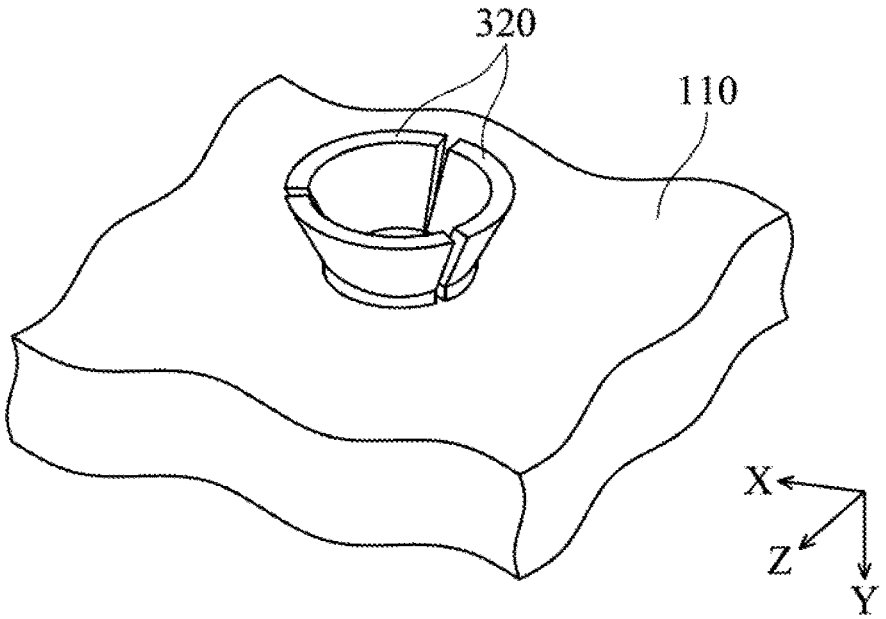
FIG. 7B is a schematic diagram of the second blades according to another embodiment of the invention.
Figure 7C:
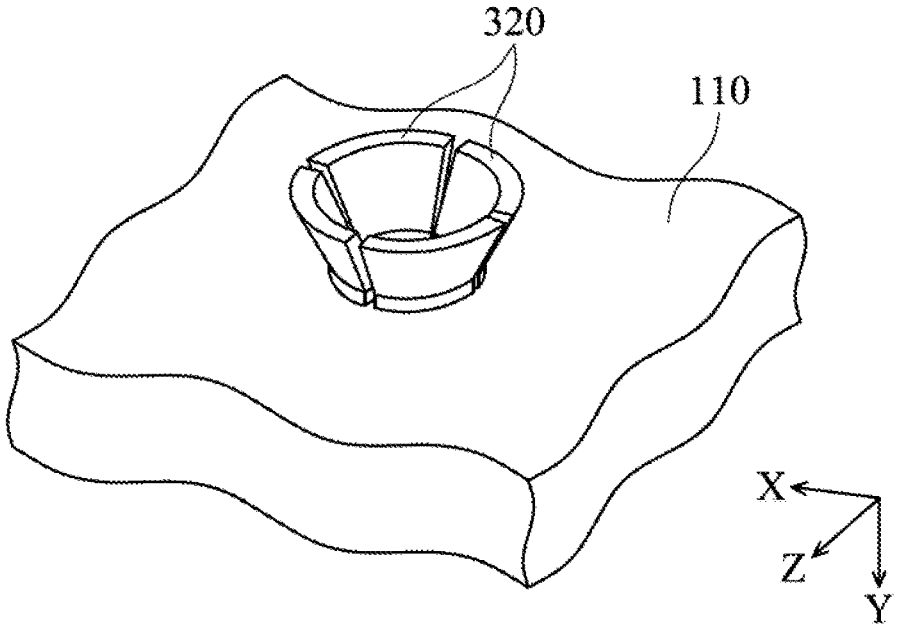
FIG. 7C is a schematic diagram of the second blades according to another embodiment of the invention.
Figure 7D:
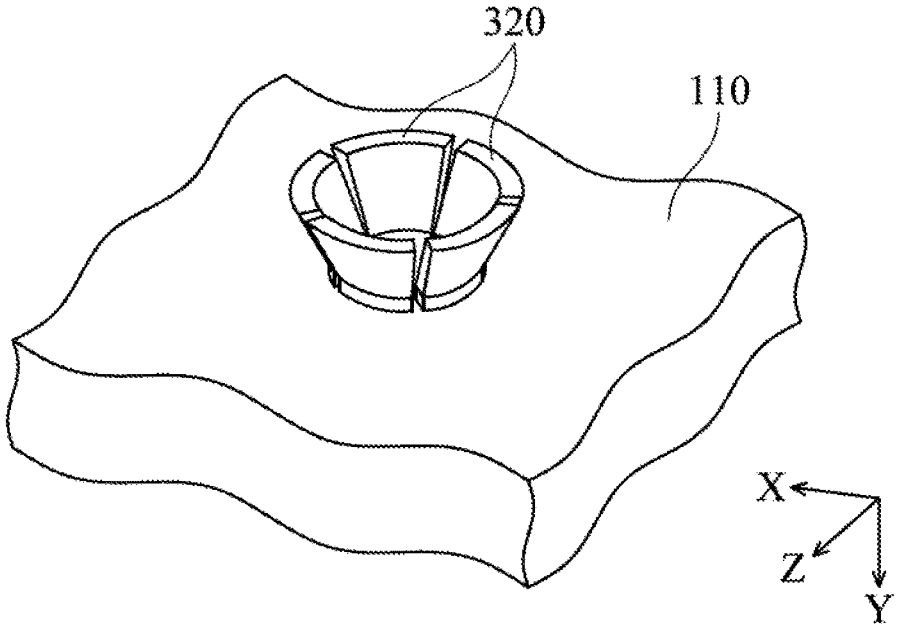
FIG. 7D is a schematic diagram of the second blades according to another embodiment of the invention.

Referring to FIGS. 5 and 6, in another embodiment, an electronic device comprises a printed circuit board 100, a hollow tube 200, a plurality of blades 300, and a solder 400. The hollow tube 200 is extended through the hole 130 and connected to the blades 300 at the first surface 110. When the wire W is inserted into the hollow tube 200, it can be clamped by at least one concave structure 210 on the inner wall of the hollow tube 200.

The diameter of the hollow tube 200 is substantially the same as that of the hole 130, such that the outer wall of the hollow tube 200 can contact the wall of the hole 130, and oscillation between the hollow tube 200 and the printed circuit board 100 can be avoided. Moreover, the hollow tube 200 further comprises a protrusion 220. The width W1 of the protrusion 220 exceeds the width W2 of the hole 130, and the protrusion 220 can contact the second surface 120 of the printed circuit board 100. Therefore, the length of the portion of the hollow tube 200 entering the hole 130 can be determined, and the hollow tube 200 can be prevented from falling through the hole 130.

In this embodiment, the blades 300 comprise six second blades 320 separated from each other. The difference between the second blades 320 and the aforementioned first blades 310 is that the second blades 320 are not attached to the first surface 110 of the printed circuit board 100. The second blades 320 protrude from the first surface 110 of the printed circuit board 100, and a reflex angle β is formed between the inner wall of the hollow tube 200 and each of the second blades 320, wherein the reflex angle β is 180 degrees-270 degrees.

As shown in FIG. 5, each of the second blades 320 has an inner surface 321 and an outer surface 322, wherein the inner surface 321 is opposite to the outer surface 322 and connected to the inner wall of the hollow tube 200. A portion of the solder 400 can be disposed between the outer surfaces 322 of the second blades 320 and the first surface 110 of the printed circuit board 100 to adhere the second blades 320 to the printed circuit board 100. Therefore, the quantity of the solder 400 can be enlarged, and the fixing effect is improved.

Similarly, since the hollow tube 200 is connected to the second blades 320 inclined relative to the first surface 110, the hollow tube 200 cannot be pulled out from the second surface 120 easily. Furthermore, since the second blades 320 are disposed separately, the solder 400 can contact the second blades 320 and the printed circuit board 100 at the sides of the second blades 320 (between two adjacent second blades 320) and the outer surfaces 322 of the second blades 320. The second blades 320 and the printed circuit board 100 can be adhered together by the solder 400 to prevent rotation of the hollow tube 200 and the second blades 320 relative to the printed circuit board 100. Since the area of contact between the solder 400 and the blades 300 is enlarged, the blades 300 can be affixed to the printed circuit board 100 steadily.

In this embodiment, a portion of the solder 400 enters the hollow tube 200, such that the quantity of the solder 400 and the area of contact for the solder 400 can be enlarged, and the fixing effect is improved. It should be noted that, even when the solder 400 enters the hollow tube 200, a gap is still formed between the solder 400 and the wire W to prevent a short-circuit from occurring. In this embodiment, the hollow tube 200 and the blades 300 comprise nickel, and can be integrally formed as one piece.

In some embodiments, the number of second blades 320 can be adjusted as required. Referring to FIGS. 7A-7D, for example, the number of second blades 320 can be two to five. When the number of second blades 320 is greater, the area of contact for the solder 400 is enlarged. However, the number of second blades 320 should be adjusted according to the dimensions of the hollow tube 200. For example, when the hollow tube 200 has a small diameter (such as the inner diameter of the hollow tube 200 is 0.1 mm-0.3 mm), the electronic device having six second blades 320 connected to the hollow tube 200 is preferred.

Figure 8A:
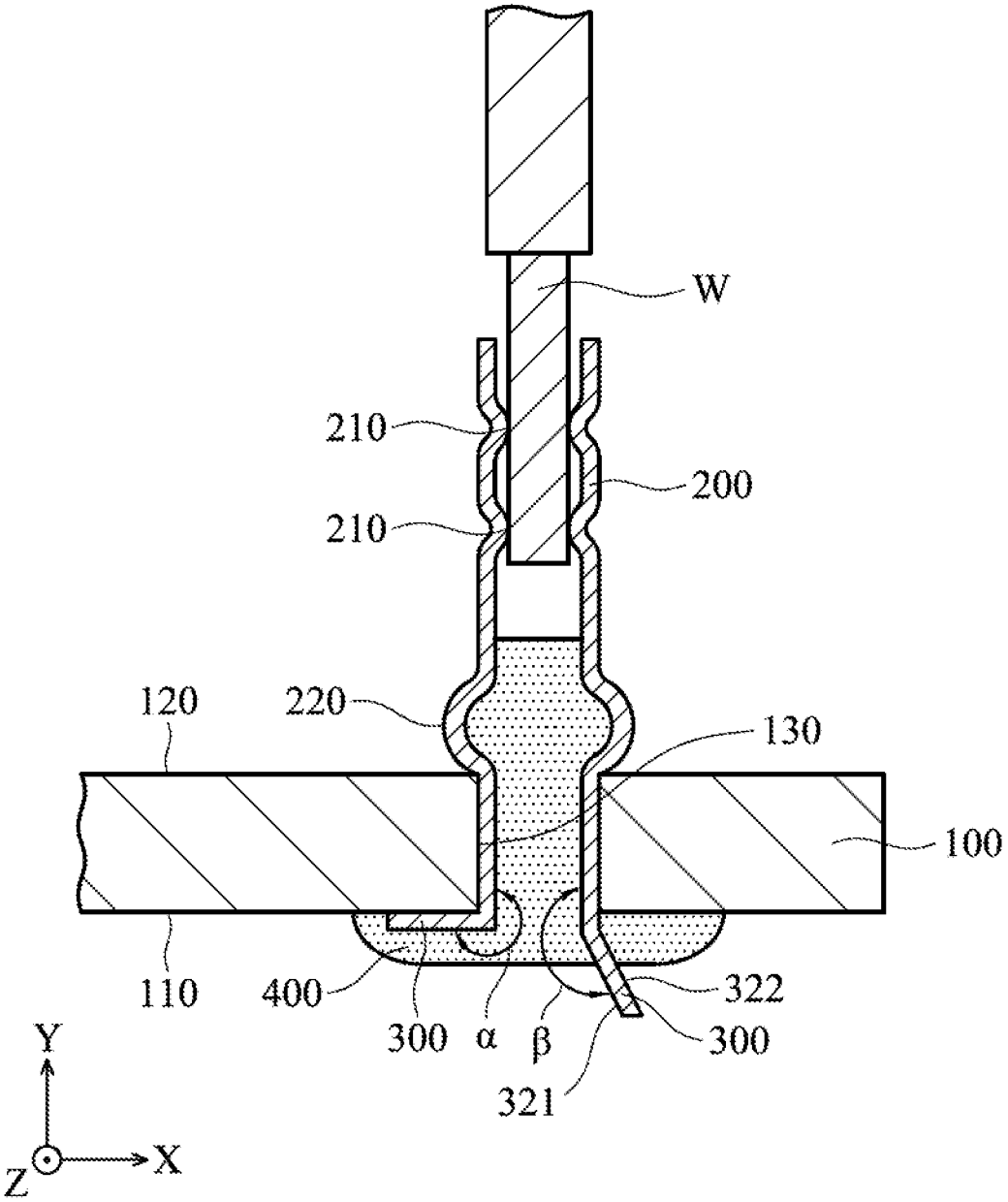
FIG. 8A is a schematic diagram of an electronic device according to another embodiment of the invention.
Figure 8B:
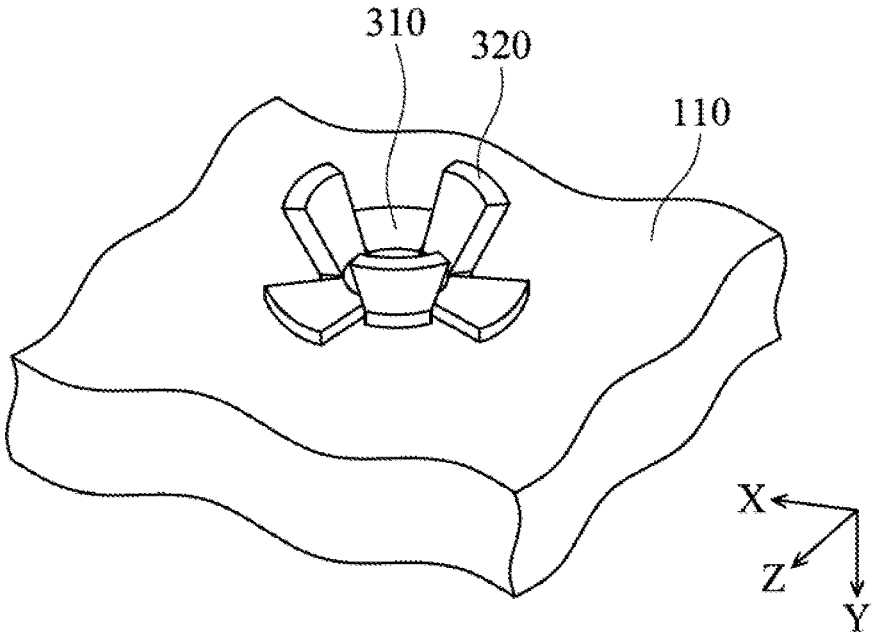
FIG. 8B is a schematic diagram of the first blades and the second blades according to another embodiment of the invention.

Referring to FIGS. 8A and 8B, in another embodiment, an electronic device comprises a printed circuit board 100, a hollow tube 200, a plurality of blades 300, and a solder 400. The hollow tube 200 is extended through the hole 130 and connected to the blades 300 at the first surface 110. When the wire W is inserted into the hollow tube 200, it can be clamped by at least one concave structure 210 on the inner wall of the hollow tube 200.

The diameter of the hollow tube 200 is substantially the same as that of the hole 130, such that the outer wall of the portion of the hollow tube 200 accommodated in the hole 130 can contact the wall of the hole 130, and the oscillation between the hollow tube 200 and the printed circuit board 100 can be avoided. Moreover, the hollow tube 200 further comprises a protrusion 220. The width of the protrusion 220 exceeds the width of the hole 130, and the protrusion 220 can contact the second surface 120 of the printed circuit board 100. Therefore, the length of the portion of the hollow tube 200 entering the hole 130 can be determined, and the hollow tube 200 can be prevented from falling through the hole 130.

In this embodiment, the blades 300 comprise three first blades 310 and three second blades 310. The first blades 310 and the second blades 320 are separated and staggered. The first blades 310 are attached on the first surface 110, and a reflex angle α is formed between the inner wall of the hollow tube 200 and each of the first blades 310, wherein the reflex angle α is about 270 degrees. A reflex angle β is formed between the inner wall of the hollow tube 200 and each of the second blades 320, wherein the reflex angle β is 180 degrees-270 degrees. Furthermore, each of the second blades 320 has an inner surface 321 and an outer surface 322, wherein the inner surface 321 is opposite to the outer surface 322 and connected to the inner wall of the hollow tube 200.

The solder 400 surrounds the first blades 310 and connects the first blades 310 with the printed circuit board 100. Furthermore, the solder 400 can be disposed between the outer surfaces 322 of the second blades 320 and the first surface 110 of the printed circuit board 100. Thus, the first blades 310 and the second blades 320 can be affixed to the circuit board 100 by the solder 400. Since the quantity of the solder 400 is enlarged, the fixing effect is improved.

Since the hollow tube 200 is connected to the first blades 310 and the second blades 320, the hollow tube 200 cannot be pulled out from the second surface 120 easily. Furthermore, since the first blades 310 and the second blades 320 are disposed separately, the solder 400 can contact the sides of the first blades 310, the outer circumference of the first blades 310, the sides of the second blades 320, and the outer surfaces 322 of the second blades 320 with the first surface 110 of the printed circuit board 100. The first blades 310 and the second blades can therefore be affixed to the printed circuit board 100 by the solder 400, and any rotation of the hollow tube 200, the first blades 310 and the second blades relative to the printed circuit board 100 can be prevented.

Since the area of contact between the solder 400 and the blades 300 is enlarged, the blades 300 can be affixed to the printed circuit board 100 steadily.

In this embodiment, a portion of the solder 400 enters the hollow tube 200, so that the quantity of the solder 400 and the area of contact for the solder 400 can be enlarged, and the fixing effect is improved. It should be noted that, even when the solder 400 enters the hollow tube 200, a gap is still formed between the solder 400 and the wire W to prevent a short-circuit from occurring. In this embodiment, the hollow tube 200 and the blades 300 comprise nickel, and can be integrally formed as one piece.

Figure 9:
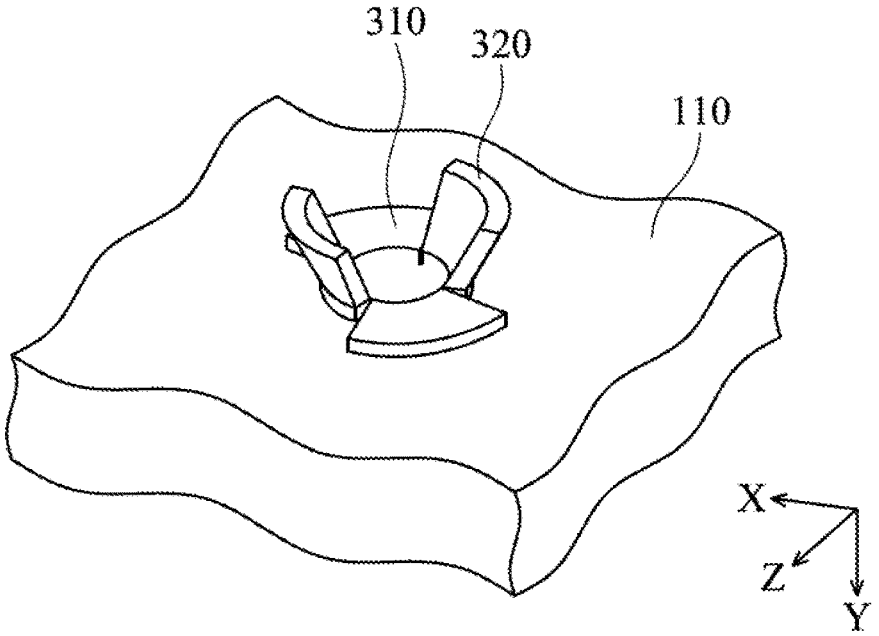
FIG. 9 is a schematic diagram of the first blades and the second blades according to another embodiment of the invention.

As shown in FIG. 9, in another embodiment, the blades 300 comprise two first blades 310 and two second blades 320. The first blades 310 and the second blades 320 are separated and staggered. It should be noted that the numbers and positions of the first blades 310 and the second blades 320 can be adjusted as required. For example, the first blades 310 and the second blades 320 can be non-staggered. Therefore, even if the total number of blades 300 is odd, the blades 300 can still comprise the first blades 310 and the second blades 320. When the hollow tube 200 has a small diameter (such as the inner diameter of the hollow tube 200 is 0.1 mm-0.3 mm), the electronic device having three first blades 310 and three second blades 320 is preferred, wherein the first blades 310 and the second blades 320 are staggered.

Figure 10:
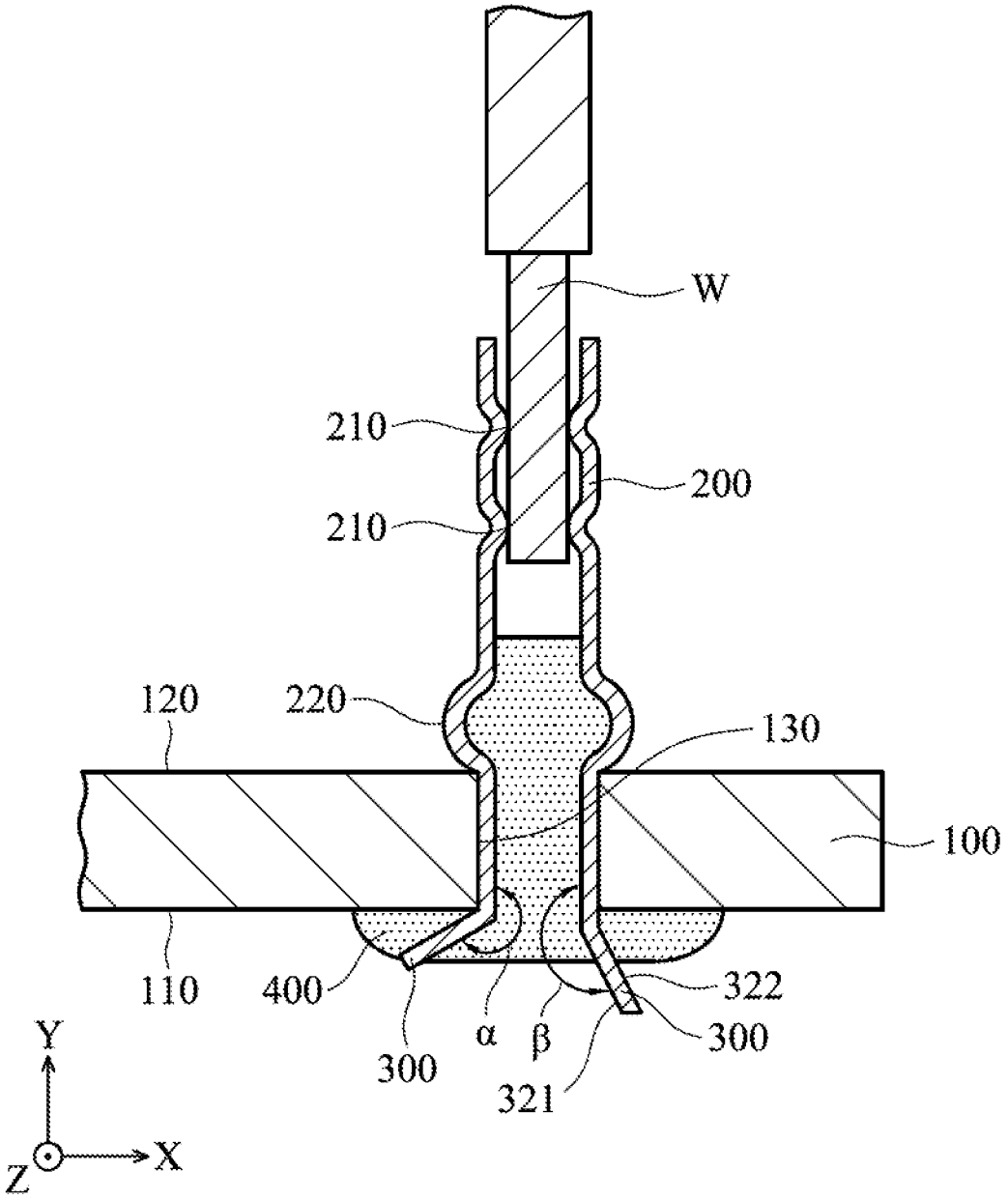
FIG. 10 is a schematic diagram of the first blades and the second blades according to another embodiment of the invention.

As shown in FIG. 10, in another embodiment, the reflex angle $\alpha$ between the first blades 310 and the inner wall of the hollow tube 200 can be 180 degrees-270 degrees, and the reflex angle $\beta$ between the second blades 320 and the inner wall of the hollow tube 200 can be 180 degrees-270 degrees, wherein the reflex angle $\alpha$ is different from the reflex angle $\beta$ (for example, the reflex angle $\alpha$ is 250 degrees and the reflex angle $\beta$ is 200 degrees).

Figure 11A:
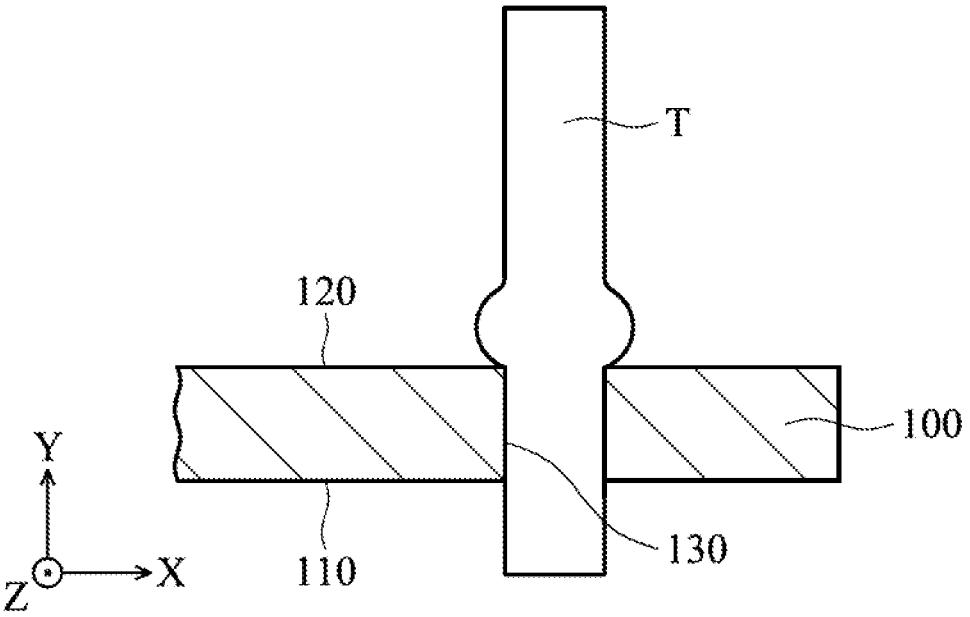
FIG. 11A is a schematic diagram of a tubular member through a hole of a printed circuit board according to an embodiment of the invention.
Figure 11B:
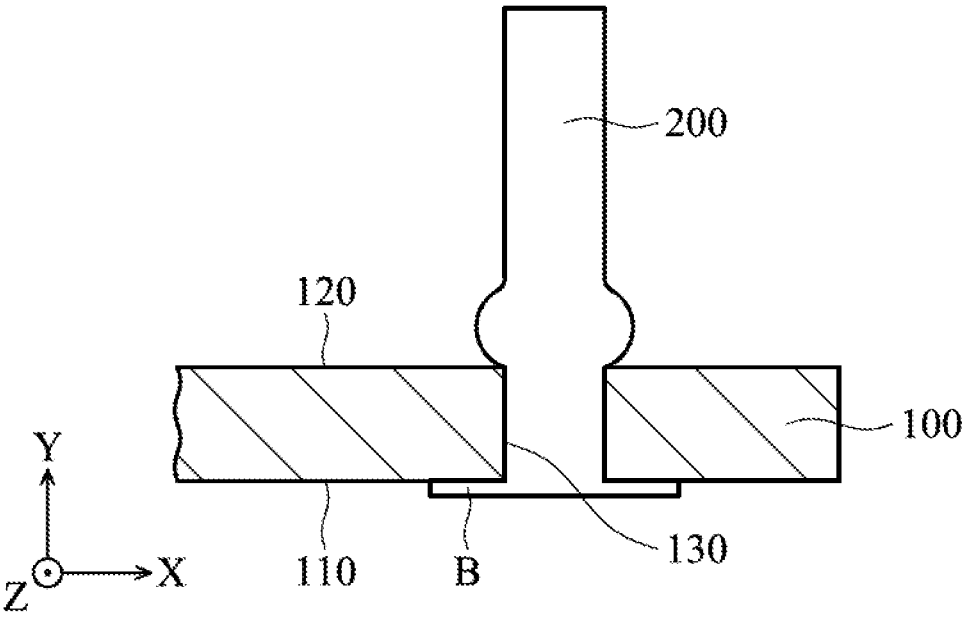
FIGS. 11B and 11C are schematic diagrams representing bending a portion of the tubular member protruding from the first surface of the printed circuit board to form a hollow tube and a bending portion according to an embodiment of the invention.
Figure 11C:
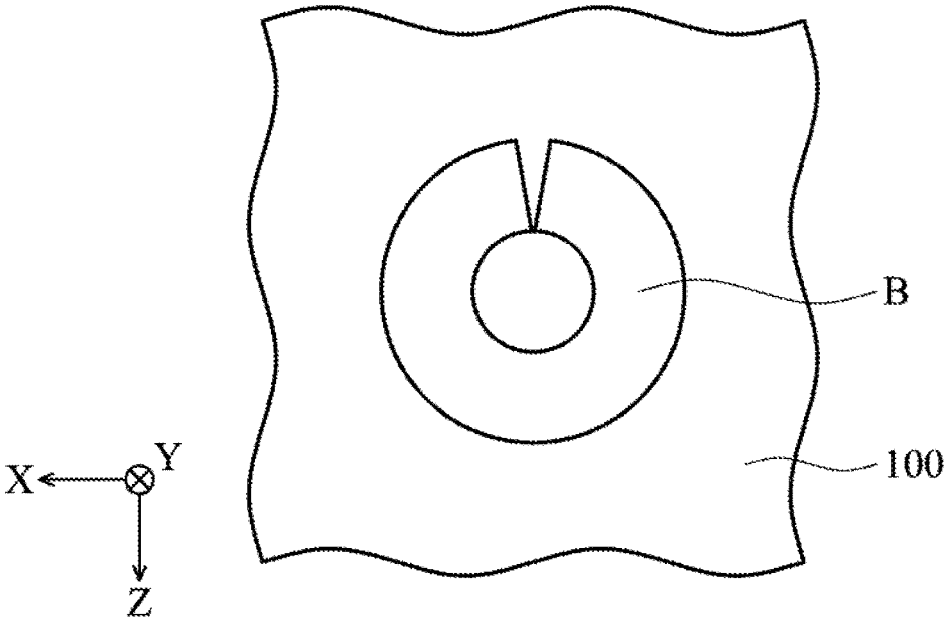

The connecting method for connecting a wire W to a printed circuit board 100 is discussed below. First, referring to FIG. 11A, a tubular member T can be disposed in a hole 130 of the printed circuit board 100, wherein a portion of the tubular member T protrudes from a first surface 110 of the printed circuit board 100. Then, as shown in FIGS. 11B and 11C, the portion of the tubular member T protruding from the first surface 110 of the printed circuit board 100 can be bent outwardly, and a hollow tube 200 and a bending portion B attached on the first surface 110 of the printed circuit board 100 can be formed.

Figure 11D:
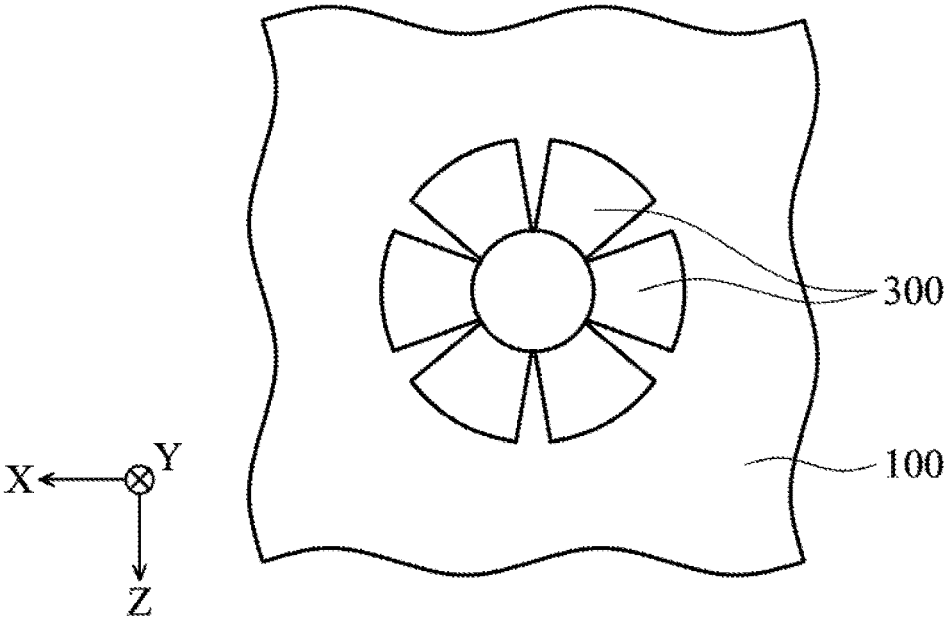
FIG. 11D is a schematic diagram representing cutting the bending portion to form a plurality of blades according to an embodiment of the invention.
Figure 11E:
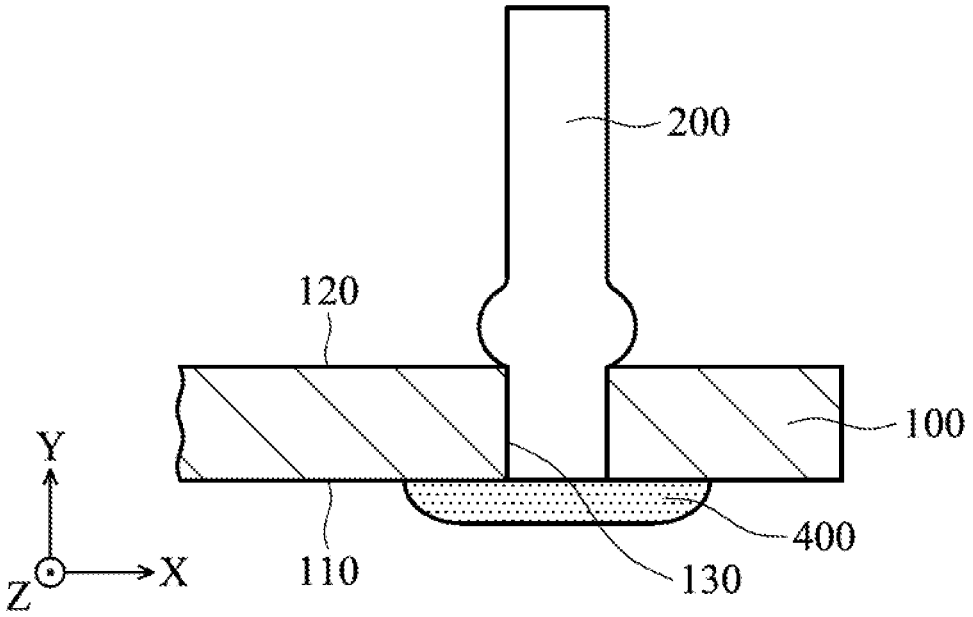
FIGS. 11E and 11F are schematic diagrams representing welding the blades to the printed circuit board according to an embodiment of the invention.
Figure 11F:
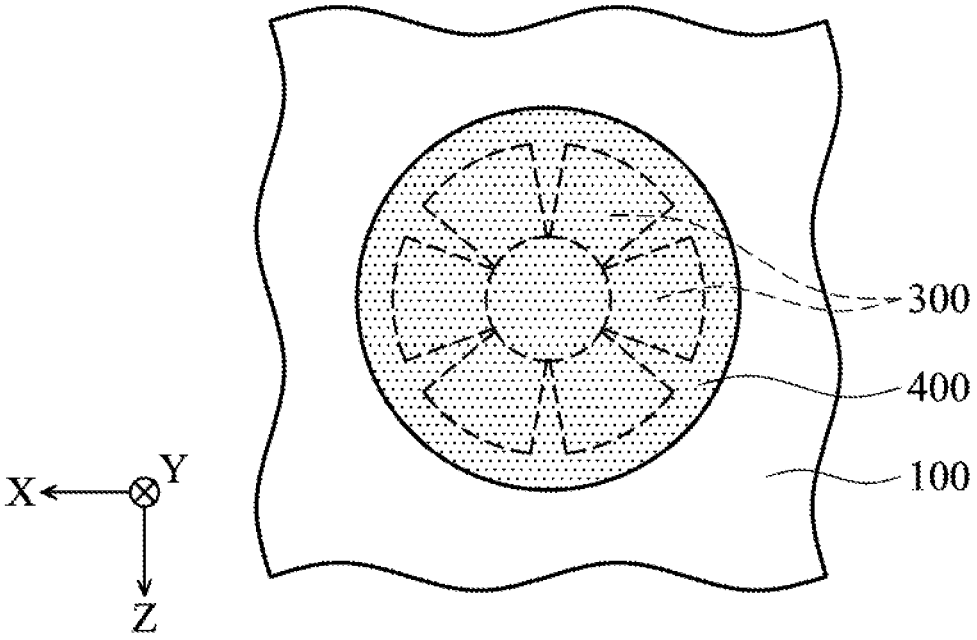

As shown in FIG. 11D, the bending portion B can be cut to form a plurality of blades 300 separated from each other. After the cutting step, the angle between each of the blades 300 and the first surface 110 can be selectively adjusted. Referring to FIGS. 11E and 11F, the blades 300 can be welded to the first surface 110 of the printed circuit board 100.

Figure 11G:
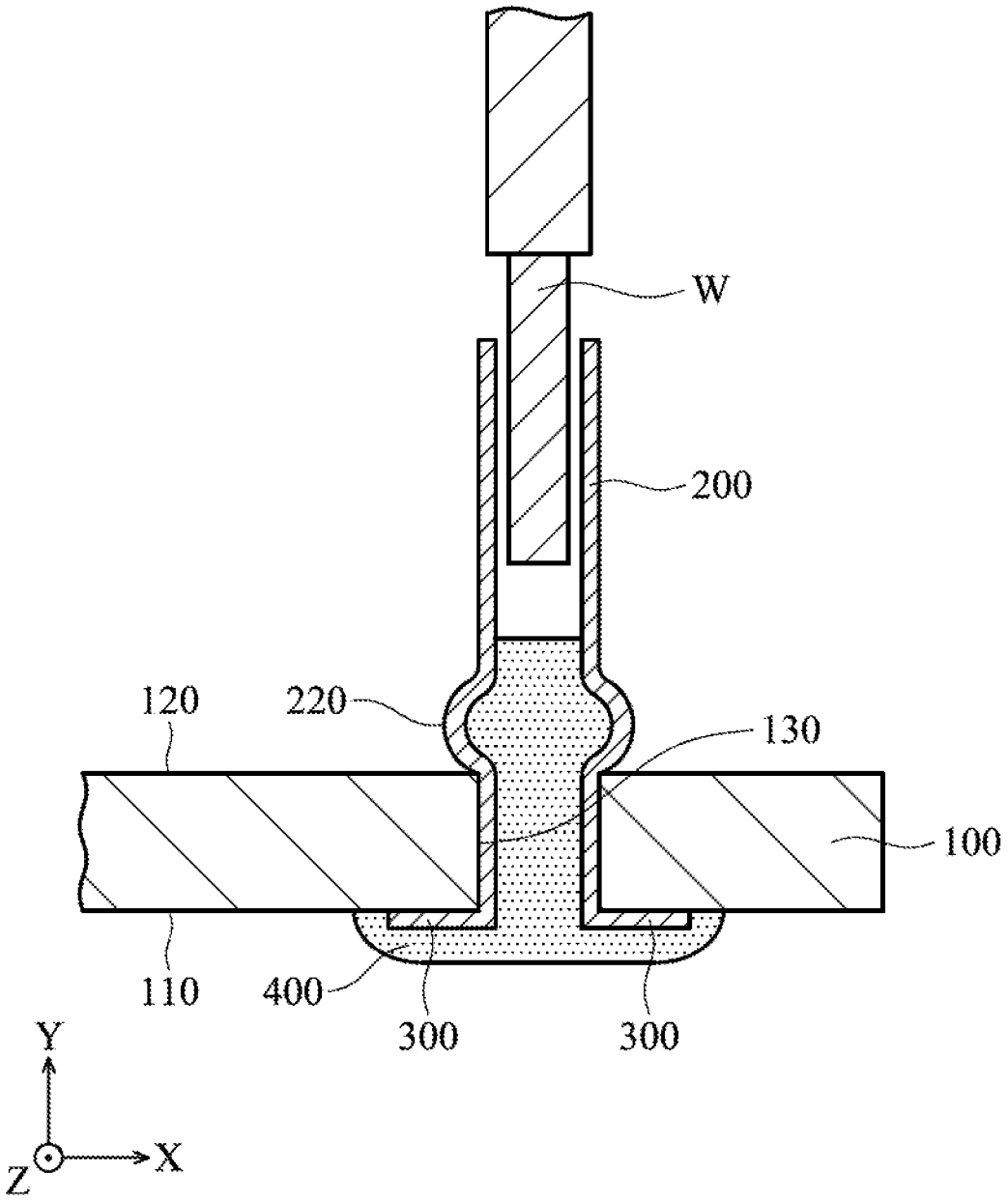
FIG. 11G is a schematic diagram of a wire inserted into the hollow tube according to an embodiment of the invention.
Figure 11H:
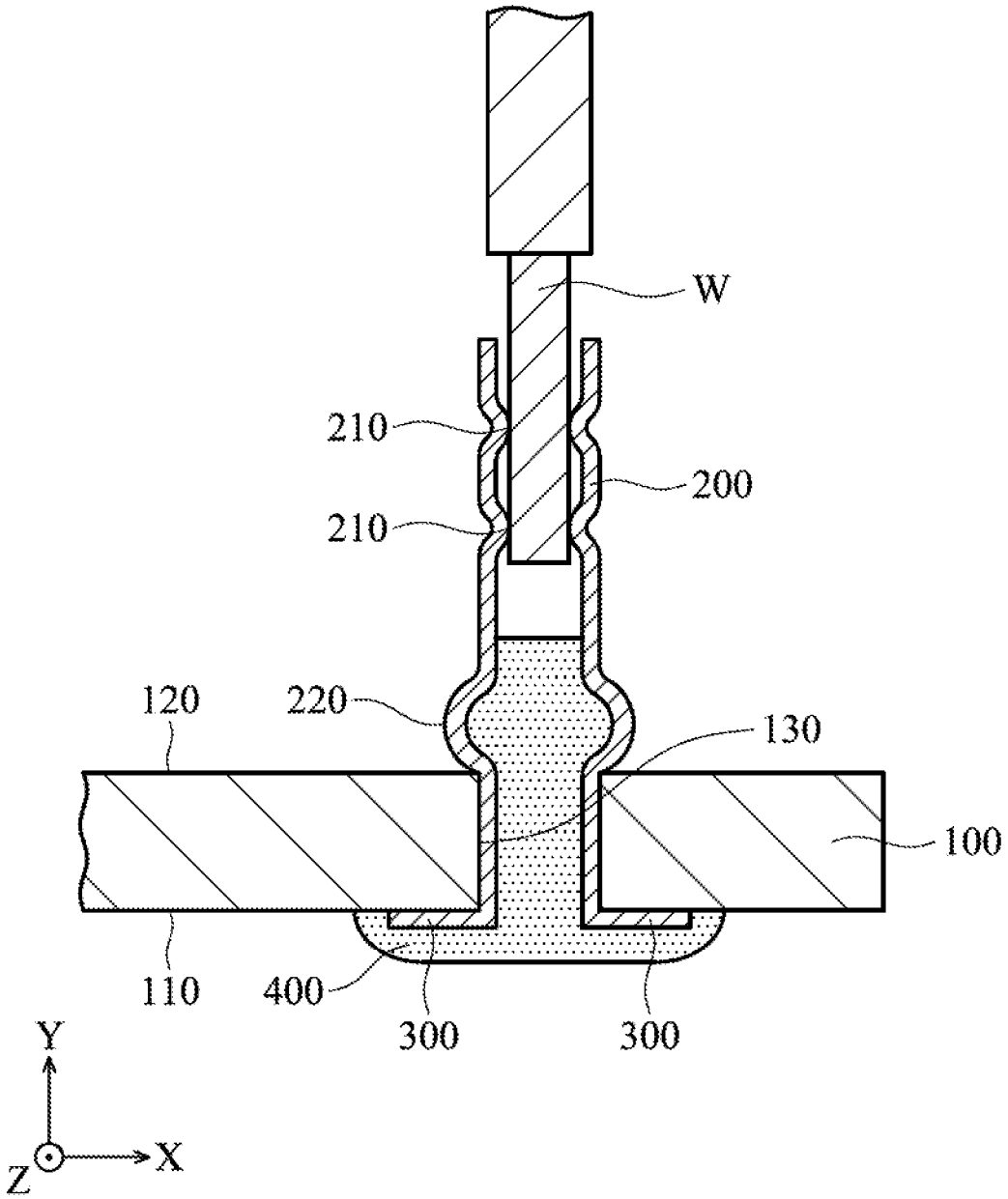
FIG. 11H is a schematic diagram representing compressing the wall of the hollow tube according to an embodiment of the invention.

Finally, referring to FIGS. 11G and 11H, the wire W can be inserted into the hollow tube 200, and the wall of the hollow tube 200 can be compressed. The inner wall of the hollow tube 200 can contact the wire W, and the wire W can be fixed in the hollow tube 200.

In summary, an electronic device is provided. Since the area of contact and the quantity of the solder is enlarged by the separated blades of the electronic device, the hollow tube can be affixed to the printed circuit board steadily.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, compositions of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. Moreover, the scope of the appended claims should be accorded the broadest interpretation so as to encompass all such modifications and similar arrangements.

While the invention has been described by way of example and in terms of preferred embodiment, it should be understood that the invention is not limited thereto. On the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. An electronic device connected to a wire, comprising:

a printed circuit board, having a hole;

a hollow tube, extended through the hole and comprising at least one concave structure, wherein the concave structure contacts the wire;

a plurality of blades, connected to the hollow tube and separated from each other, wherein a reflex angle is formed between the inner wall of the hollow tube and each of the blades, and the printed circuit board is disposed between the concave structure and the blades; and a solder, connected to the blades and the printed circuit board, wherein the wire is inserted into the hollow tube and electrically connected to the printed circuit board, wherein half of the blades are parallel and attached to the printed circuit board, and half of the blades are inclined relative to the printed circuit board, wherein each of the inclined blades is a flat plate, and the opposite surfaces of each of the inclined blades are exposed from the solder.

2. The electronic device as claimed in claim 1, wherein the blades comprise at least one first blade, the reflex angle formed between the inner wall of the hollow tube and the first blade is 180 degrees-270 degrees.

3. The electronic device as claimed in claim 1, wherein the blades comprise at least one blade, the reflex angle formed between the inner wall of the hollow tube and the first blade is 270 degrees, the first blade contacts the printed circuit board, and the solder surrounds the first blade.

4. The electronic device as claimed in claim 1, wherein the blades comprise at least one second blade, the reflex angle formed between the inner wall of the hollow tube and the second blade is 180 degrees-270 degrees.

5. The electronic device as claimed in claim 4, wherein the second blade has an inner surface and an outer surface opposite to the inner surface, wherein the inner surface is connected to the inner wall of the hollow tube, and a portion of the solder is disposed between the outer surface and the printed circuit board.

6. The electronic device as claimed in claim 1, wherein the blades comprise a plurality of first blades and a plurality of second blades, the reflex angle formed between the inner wall of the hollow tube and each of the first blades exceeds that between the inner wall of the hollow tube and each of the second blades, and the first blades and the second blades are staggered.

7. The electronic device as claimed in claim 1, wherein the printed circuit board has a first surface and a second surface, wherein the hole extends from the first surface to the second surface, and the blades protrude from the first surface.

8. The electronic device as claimed in claim 7, wherein the first surface is opposite to the second surface.

9. The electronic device as claimed in claim 7, wherein the hollow tube comprises a protrusion, wherein the width of the protrusion exceeds that of the hole, and the protrusion contacts the second surface.

10. The electronic device as claimed in claim 1, wherein a portion of the solder enters the hollow tube.

11. The electronic device as claimed in claim 1, wherein a gap is formed between the solder and the wire.

12. The electronic device as claimed in claim 1, wherein the number of blades is two to six.

13. The electronic device as claimed in claim 1, wherein the hollow tube comprises nickel.

14. A connecting method for connecting a wire to a printed circuit board, comprising:

disposing a tubular member in a hole of the printed circuit board;

bending a portion of the tubular member protruding from a first surface of the printed circuit board to form a hollow tube and a bending portion;

cutting the bending portion to form a plurality of blades;

welding the blades and the printed circuit board;

inserting the wire into the hollow tube; and compressing the wall of the hollow tube to form a concave structure until the inner wall of the hollow tube contacts the wire, and the printed circuit board is disposed between the concave structure and the blades, wherein half of the blades are parallel and attached to the printed circuit board, and half of the blades are inclined relative to the printed circuit board, wherein each of the inclined blades is a flat plate, and the opposite surfaces of each of the inclined blades are exposed from the solder.

15. The connecting method as claimed in claim 14, wherein the connecting method further comprises adjusting the angle between the first surface and each of the blades.

* * * * *